United States Patent [19]

Murakami

[11] 4,042,061

[45] Aug. 16, 1977

[54] CELL-BOX-TYPE NOISE BARRIER HAVING LARGE MAGNITUDE OF TRANSMISSION LOSS AND NOISE INSULATING METHOD

[75] Inventor: Norio Murakami, Kawasaki, Japan

[73] Assignee: Showa Koji K. K., Kawasaki, Japan

[21] Appl. No.: 665,230

[22] Filed: Mar. 9, 1976

[30] Foreign Application Priority Data

July 12, 1975 Japan ..... 50-84926

[51] Int. Cl.[2] ..... E04B 1/86; G10K 11/04

[52] U.S. Cl. ..... 181/33 HE; 181/33 G; 181/33 GB

[58] Field of Search ..... 181/33 HE, 33 R, 33 G, 181/33 GB, 33 GD, 33 GE, 30; 256/24, 13.1; 244/114 R

[56] References Cited

U.S. PATENT DOCUMENTS

| | | | |
|---|---|---|---|
| 2,085,436 | 6/1937 | Maurer | 181/33 GB |
| 2,276,788 | 3/1942 | Norris | 181/30 |
| 3,234,996 | 2/1966 | King et al. | 181/33 GB |
| 3,295,273 | 1/1967 | Wehe, Jr. | 181/33 GB |
| 3,592,289 | 7/1971 | Aysta et al. | 181/33 GB |
| 3,656,576 | 4/1972 | Gubela | 181/33 HE |
| 3,866,001 | 2/1975 | Kleinschmidt et al. | 181/33 G |

*Primary Examiner*—Stephen J. Tomsky
*Attorney, Agent, or Firm*—Oblon, Fisher, Spivak, McClelland & Maier

[57] ABSTRACT

A noise barrier having a large magnitude of transmission loss is disclosed which is formed of a cell-box-type noise barrier comprising (A) a hollow cell-type block having a perforated sound-absorbing plate disposed on the side confronting the source of noise and a sound-insulating plate disposed on the opposite side relative to said perforated sound-absorbing plate and incorporating therein a sound-absorbing material and (B) a free-spacing plate disposed opposite said sound-insulating plate across a space and held in position by the medium of an elastic member, with a free air layer intervening between said free-spacing plate and said sound-insulating plate. Also disclosed is a method for insulating noise by providing a free-spacing plate at a distance from a noise source in such a way as to create a free air layer.

6 Claims, 10 Drawing Figures

CELL-BOX-TYPE NOISE BARRIER HAVING LARGE MAGNITUDE OF TRANSMISSION LOSS AND NOISE INSULATING METHOD

BACKGROUND OF THE INVENTION

This invention relates to a cell-box-type noise barrier having a large magnitude of transmission loss and aims to prevent propagation of various forms of noise issuing from wheeled vehicles travelling at high speeds and from mechanical devices productive of high levels of sound and to a method for directly insulating noise from a noise source.

In recent years, noise pollution from such industrial sources as canneries and pressing shops and from such traffic sources as express ways and railroads has become so great as pose a serious social issue. To cope with this problem, engineering circles have been urged both to minimize the absolute number of noise sources and at the same time to enclose noise sources with noise barriers which are capable of absorbing the noises on their inner sides and of preventing the noises from being propagated beyond their outer sides.

The structures of such noise barriers make use of the working principles of acoustics.

The main target at which these structures are aimed resides in maximizing the transmission loss of noise (equal to 10 times the common logarithm of the ratio of the energy of received sound to the energy of transmitted sound, expressed in decibels, dB) at each frequency level within the audible range for the average person.

Generally in the case of a wall structure made of a unitary material (such as of a metal plate, for example), one can attempt to increase the magnitude of transmission loss by adding to the thickness of the wall. At a certain frequency level, however, the phenomenon of resonance occurs between the sound pressure distribution caused by the sound wave impinging upon the wall surface and the proper vibration distribution of the wall material, giving rise to the effect of coincidence. This effect brings about a decline in the magnitude of transmission loss within the audible range of frequence which is a great obstacle to the prevention of noise propagation. The phenomenon of decreased transmission loss due to resonance is inherent in a barrier structure composed of hollow cell-type blocks, although the magnitude of transmission loss itself is higher than that attainable with the wall structure made of a unitary material.

A primary object of the present invention is to provide a noise barrier which has a higher transmission loss than the wall structure made of a unitary material or the wall structure composed of hollow cell-type blocks.

Another object of the present invention is to provide a noise barrier which displays no decline in the magnitude of transmission loss due to the aforementioned phenomenon of resonance. A still further object of the present invention is to provide an extremely simple and effective method for directly insulating the noise from a noise source.

SUMMARY OF THE INVENTION

To accomplish the objects described above according to the present invention, there is provided a cell-box-type noise barrier which comprises (A) a hollow cell type block composed of a hollow cell-shaped box having a perforated sound-absorbing plate disposed on the side confronting the source of noise and a sound-insulating plate disposed on the opposite side relative to said perforated sound-absorbing plate and incorporating a sound-absorbing material to fill up the space therein and (B) a free-spacing plate disposed opposite said sound-insulating plate of the hollow cell type block across a space. Said free-spacing plate and said sound-insulating plate of the hollow cell type block are separated from each other to form a free air layer. The free-spacing plate is joined with the noise-insulating plate by the medium of an elastic member.

This combination of a hollow cell type block and a free-spacing plate constitutes the basic noise barrier. It is of course possible to use this basic structure as a noise barrier structural unit and, by combining a plurality of such units, to build up a noise barrier of larger scale.

When necessary, a plurality of said cell-box-type barriers of the present invention may be piled up one on top of another. While the assembly of such plurality of cell-box-type noise barriers of this invention which are merely piled up one on top of another is also embraced by the present invention, this invention encompasses a particularly characteristic manner of assembly.

Namely, in the assembled structure, the connecting edge portions of the perforated sound-absorbing plate and sound-insulating plate of each of the component boxes have outwardly bent legs, which are so designed that when said component boxes are piled up one on top of another, the legs of the vertically adjoining perforated sound-absorbing plates and sound-insulating plates are brought into tight union. The noise-insulating effect of the hollow cell type block can be enhanced by dividing the hollow interior into a plurality of cells and filling these cells with a sound-absorbing material.

Highly effective noise insulation can also be attained by providing a free-spacing plate at a distance from a noise source in such a way as to create a free air layer.

The other characteristics and advantages of the present invention will become apparent from the description to be given in further detail herein below with reference to the accompanying drawing.

DETAILED DESCRIPTION OF THE INVENTION

Figure 1:
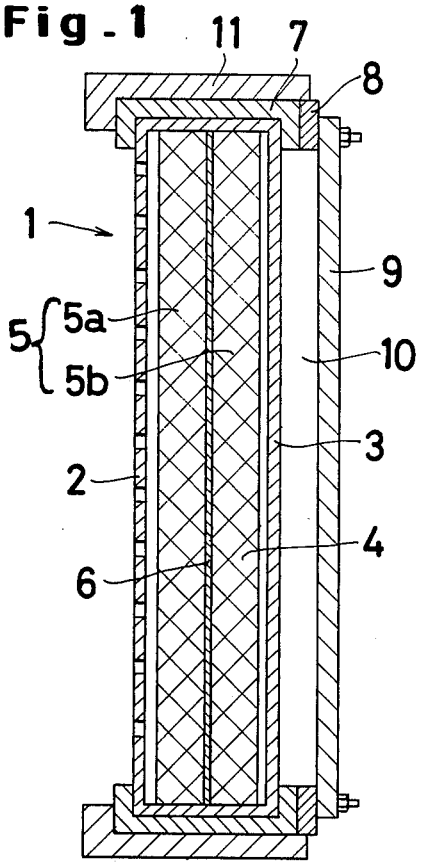
FIG. 1 is a longitudinal cross section depicting the structure of one typical embodiment of the noise barrier of the present invention.

FIG. 1 is a longitudinal cross section depicting the structure of one typical embodiment of the noise barrier of the present invention. In the diagram, 1 denotes a hollow cell-shaped box (rectangular parallelepiped). This hollow cell-shaped box can be made of any of various materials. Where the ease of fabrication is taken into consideration, materials such as aluminum, aluminum alloys and iron prove to be advantageous. Said hollow cell-shaped box can easily be manufactured by integral extruding of any of the aforementioned materials. The box weight per square meter of the surface area of this hollow cell-shaped box is generally in the range of from 10 to 30 kg. The optimum values for the plate thickness and other particulars of this box can be calculated on the basis of the frequence of the sound wave expected to impinge upon the barrier. The distance between the opposed cell plates (i.e. the air mass in a cell) can be determined for thereby allowing the magnitude of transmission loss to be the largest on the basis of the basic resonance frequence of the sound wave involved.

The plate of the hollow cell-shaped box 1 which confronts the source of noise has perforations (of a diameter of 8 mm, for example) bored therein at a prescribed aperture ratio (30%, for example) so as to constitute itself a perforated sound-absorbing plate 2. The plate on the opposite side relative to said perforated sound-absorbing plate 2 is referred to as a sound-insulating plate 3.

The interior space of the hollow cell-shaped box 1 is filled with a commonly used sound-absorbing material 4 (a fibrous material such as, for example, glass wool) to form a compartment 5 housing a sound-absorbing layer. As illustrated in the diagram, said compartment 5 of the sound-absorbing layer may be divided into two smaller compartments 5*a* and 5*b* by insertion of a partition plate 6, with said smaller compartments desirably filled with the sound-absorbing material. The compartment 5 may otherwise be split into more than 2 smaller compartment to satisfy the convenience of the occasion. Optionally, a perforated plate adapted to be inserted and held in position by the medium of an elastic member may be used as the partition plate to suit the particular purpose. Where said hollow cell-shaped box is manufactured by integral extruding, the partition plate 6 may be formed simultaneously as an integral part of the box. Otherwise, it may be inserted in position and held fast by the medium of a member within the integrally extruded box.

The hollow cell-shaped box and the sound-absorbing material incorporated therein together compose a noise insulating hollow cell type block.

Denoted by 7 is a cover having a cross section of the shape of a groove. The upper and lower open ends of the box are closed by having the corresponding edges of the box inserted into such covers. By 9 is denoted a free-spacing plate which is disposed opposite the sound-insulating plate across a space and parallel therewith. Denoted by 10 is a free air layer which is formed between the free-spacing plate and the sound-insulating plate. An elastic member 8 is interposed between the sound-insulating plate and the free-spacing plate. By 11 is denoted an elastic packing which is incorporated optionally.

A hollow cell type block inevitably suffers from a decline in the magnitude of transmission loss due to the phenomenon of resonance, although the magnitude of transmission loss is still larger than that attainable with the wall structure made of a unitary material. The present invention, therefore, has the hollow cell type block combined with the free-spacing plate by the medium of said elastic member 8 to preclude the occurrence of the phenomenon of resonance.

The thickness of the free-spacing plate and the volume of the free air layer are determined by the particular kind of the noise source. Said plate is preferably made of a metallic material (such as, for example, aluminum, iron).

The magnitude of transmission loss can further be increased by filling the free air layer with the sound-absorbing material.

The primary reason for the large magnitude of transmission loss and the outstanding noise-insulating effect exhibited by the noise barrier wall of this invention is that the resonance is offset by the counter-to-resonance occurring because of the free air layer which intervenes between the hollow cell type block and the free-spacing plate joined thereto by the medium of the elastic member. It is also an important reason that the hollow cell type block and the free-spacing plate cooperate to bring about the various advantageous phenomena such as attenuation, absorption, interception and reflection of sound waves.

Moreover, since the hollow cell type block and the free-spacing plate are elastically connected, the absorption of sound energy is further enhanced by the warp phenomenon which occurs when noise impinges on this elastic joint and the free air layer.

Figure 2:
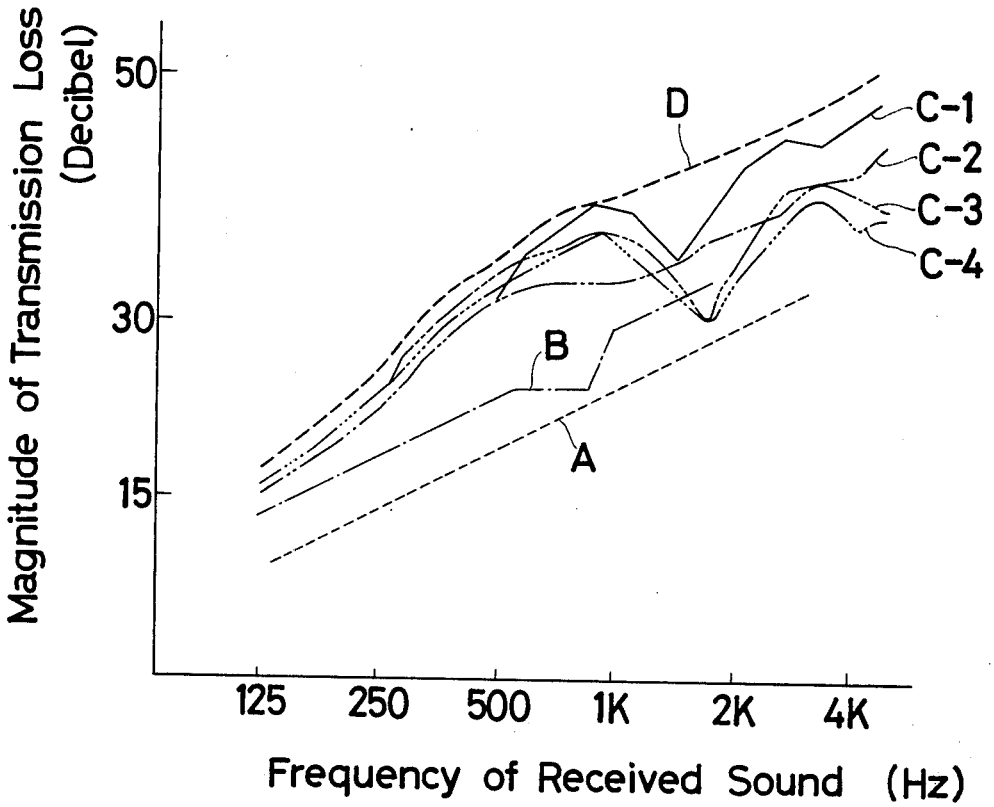
FIG. 2 is a graph showing the relation between the frequency of received sound and the magnitude of transmission loss.

The effects of the noise barrier of the present invention will be described with reference to the graph of FIG. 2. In this graph, the vertical axis is graduated for magnitude of transmission loss (in decibels) and the horizontal axis graduated for frequency (in Hz) of the received sound. The graph shows the relations between the frequency of received sound and the magnitude of transmission loss as determined with various noise barriers including that of the present invention.

The noise barriers involved herein will be described below.

A: An aluminum plate having a thickness of 2 mm.

B: An aluminum plate having a thickness of 4 mm.

C-1: An integrally extruded hollow cell-shaped box having a wall thickness of 2 mm and made of aluminum. The side of the box confronting the source of noise has perforations 8 mm in diameter bored therein at an aperture ratio of about 30%. The interior of the box is filled with a sound-absorbing material (glass wool) to a thickness of 70 mm.

C-2: A noise barrier identical in shape with that of C-1, with perforations 30 mm in diameter bored therein at an aperture ratio of about 30%. The box interior is filled with the same sound-absorbing material to a thickness of 70 mm.

C-3: A noise barrier identical in shape with that of C-1, with perforations 8 mm in diameter bored therein at an aperture ratio of about 30%. The box interior is filled with the same sound-absorbing material to a thickness of 40 mm.

C-4: A noise barrier identical in shape with that of C-1, with perforations 30 mm in diameter bored therein at an aperture ratio of about 30%. The box interior is filled with the same sound-absorbing material to a thickness of 40 mm.

D: The noise barrier of the structure illustrated in FIG. 1.

This barrier is composed of the following components:

Hollow cell-shaped box;
identical in shape and material with the noise barrier of C-1
Perforated sound-absorbing plate;
diameter of perforation — 8 mm $\phi$
aperture ratio — 30%
Sound-absorbing material;
kind — glass wool
thickness — 70 mm
Free-spacing plate;
material — aluminum
thickness — 2 mm
Free air compartment;
thickness — 70 mm
Elastic member;
material — fibre containing rubber
thickness — 25 mm In the graph, the curves A and B representing the barriers of a unitary material show that the magnitude of transmission loss increases with the increasing wall thickness but that the magnitude of transmission loss dips because of the phenomenon of resonance when the wall thickness is increased to a certain range. In the curves C-1 through C-4, the magnitudes of transmission loss are improved over those of A and B, whereas said declines in the magnitudes of transmission loss are still inherent. In the curve D representing the noise barrier of the present invention alone, the magnitude of transmission loss remains unaffected because of the absence of the phenomenon of resonance and the magnitude itself is greater than any of the magnitudes obtained with A, B, C-1, C-2, C-3 and C-4. The data, therefore, clearly indicate that the noise barrier of the present invention provides an outstanding noise-insulating effect as compared with that attainable by any of the conventional noise barriers.

The noise barrier of the present invention may desirably be so adapted that the space (free air layer) between the sound-insulating plate and the free-spacing plate can freely be varied to provide the optimum effect against the particular type of noise source. This adjusted variation of the intervening space may be accomplished, for example, by changing the thickness of the elastic member 8.

Figure 3:
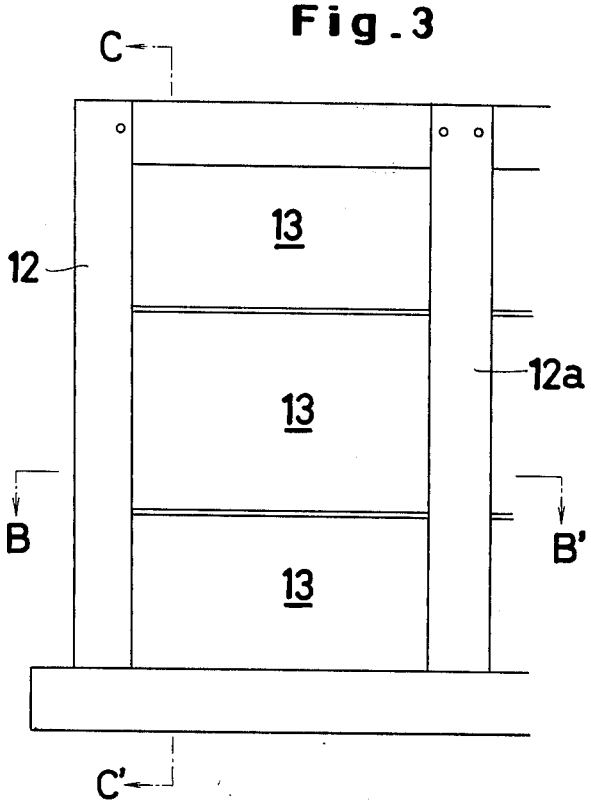
FIG. 3 is a front view illustrating one embodiment having a plurality of noise barriers of this invention piled up one on top of another.
Figure 5:
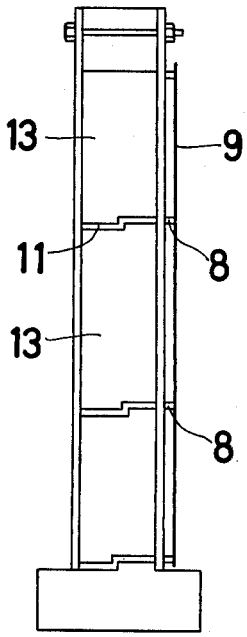
FIG. 5 is a lateral cross-sectional view taken along the line C–C′ in the diagram of FIG. 3.
Figure 4:
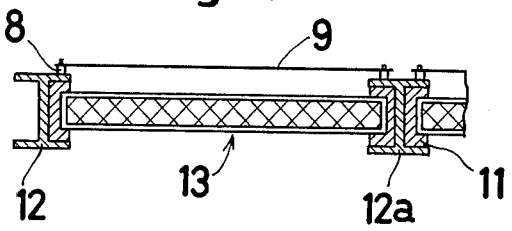
FIG. 4 is a cross-sectional view taken along the line B–B′ in the diagram of FIG. 3.

FIGS. 3 through 5 illustrate one embodiment having a plurality of noise barrier of this invention piled up one on top of another. FIG. 3 is a front view of the embodiment, in which 12 and 12*a* denote H bars serving as supporting columns. The plurality of noise barriers 13 of the present invention are inserted one after another between the opposed H bars. FIGS. 4 and 5 are the longitudinal cross-sectional view and the lateral cross-sectional view respectively taken along the lines B–B′ and C–C′ in the diagram of FIG. 3. In FIG. 5, the adjoining faces of the component noise barriers piled up are stepped. The steps are intentionally incorporated so that the expected noise-insulating effect is not degraded where the adjoining faces meet. In this assembly, an elastic packing 11 is interposed between the adjoining faces of the component barriers.

Figure 6:
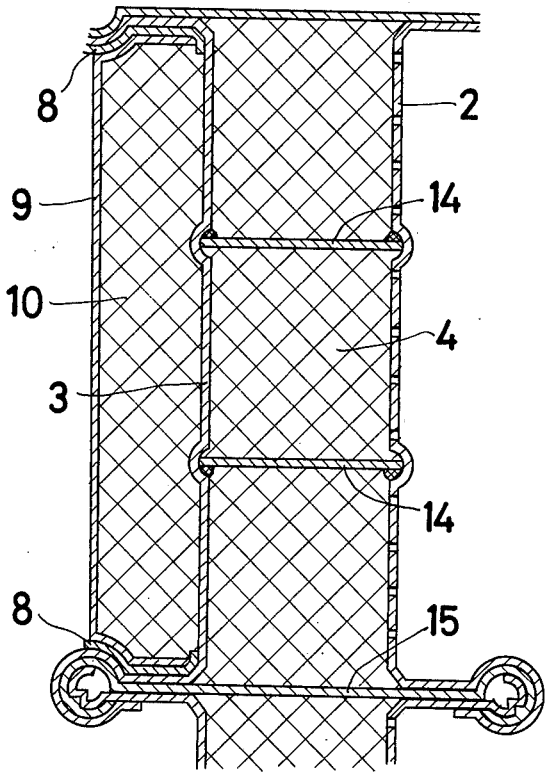
FIG. 6 is a diagram showing a structure having a plurality of noise barriers of the present invention piled up one on top of another.

FIG. 6 illustrates another preferred embodiment of the structure wherein a plurality of the noise barriers of the present invention are piled up one on top of another. In this case, the perforated sound-absorbing plate 2 and the sound-insulating plate 3 both have a cross section of a shape like the one shown in FIG. 7. In the cross section, *a* denotes a concave groove formed in the longitudinal direction in each of said plates and *b* denotes a leg bent in the direction opposite that of said groove. The extremeties *c* and *c′* of these legs are curved in to have a cross section of the shape of hooks. The curved tips *c* and *c′* have sizes such that one is larger than the other and the larger one can accommodate the smaller one. In the smaller hook, a V-shaped notch is inserted as illustrated in the diagram. The perforated sound-absorbing plate and the sound-insulating plate both measure from one to two mm in thickness. The lengths of the leg pieces thereof may suitably fixed to suit the particular purposes of design.

In the noise barrier assembly of this invention shown in FIG. 6 wherein the unit hollow cell-shaped boxes are each composed of a perforated sound-absorbing plate 2 and a sound-insulating plate 3, the connecting legs of each adjoining pair of perforated sound-absorbing plate 2 and sound-insulating plate 3 are extended in mutually opposite directions. A partition plate 14 is integrally attached in position between each pair of opposed grooves contained in said pair of plates. Actually, this integral attachment is accomplished such as by welding, soldering, adhesion, etc.

Figure 7:
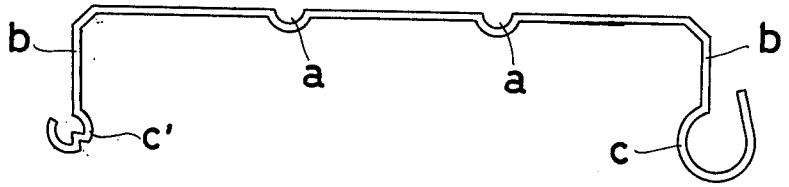
FIG. 7 is a diagram illustrating the shapes assumed by the perforated sound-absorbing plates and sound insulating plates in the assembly shown in FIG. 6.
Figure 8:
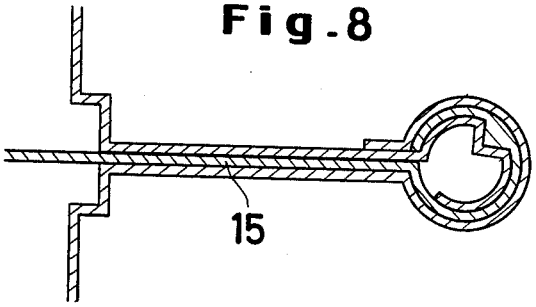
FIG. 8 is a detailed diagram illustrating the adjoining portion in the assembly of FIG. 6.

Furthermore, the joint between each adjoining pair of hollow cell-shaped boxes 1 has a structure as illustrated in FIG. 6 and FIG. 8 so that the legs of the perforated sound-absorbing plate and the sound-insulating plate which compose the box proper and an intermediate plate 15 are attached to one another and the leg *c* accommodates the leg *c′* by the medium of said intermediate plate 15. In actual practice, this structure can readily be completed by having the component plates joined with their legs set in position as illustrated. The component cell-shaped boxes in the assembly are allowed to acquire an independently closed structure. These joined portions may be further welded or soldered to ensure perfect union. The V-shaped notch which is inserted at a forward portion of the leg *c′* as illustrated in FIG. 7 is intended to confer upon said leg the resiliency which proves advantageous for the purpose of tightening said joint. The perforations in the perforated sound-absorbing plate may be formed in advance by having round holes (having a diameter of 8 mm, for example) bored to a prescribed aperture ratio (30%, for example) or they may be punched in the plate in the aforementioned manner after the component plates have been assembled to complete the hollow cell-shaped box structure. The sound-absorbing material 4 is incorporated to fill up the space intervening between the two opposed plates. Denoted by 9 is the free-spacing plate which is connected with the end portion of the sound-insulating plate by the medium of an elastic member 8, embracing the free air layer 10.

The number of said hollow cell type blocks and that of said free air layers are not always required to be equal to each other. The structure completed by combining said blocks and layers may suitably be modified to suit the condition of the place available for the installation of the barrier structure, the method of manufacture and the particular kind of noise source.

Figure 9:
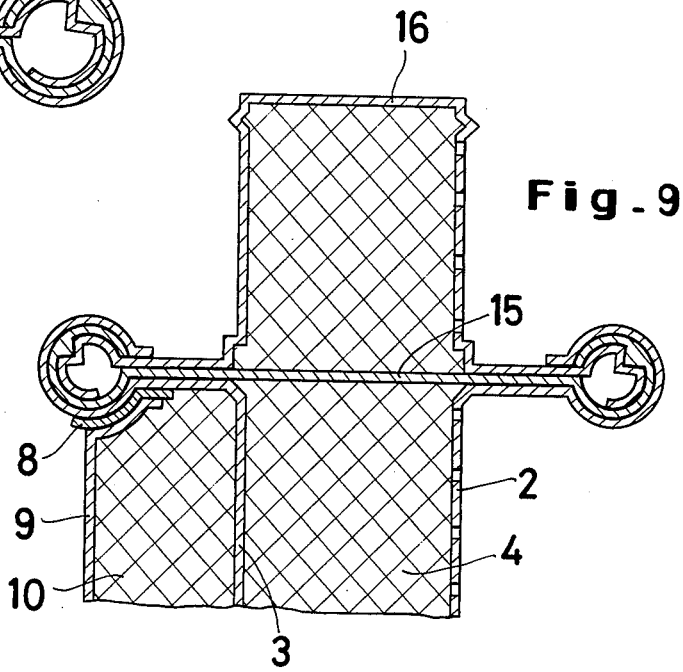
FIG. 9 and FIG. 10 are diagrams showing the structures involved in tightly sealing the ends of adjoining boxes in the assembly of FIG. 6.
Figure 10:
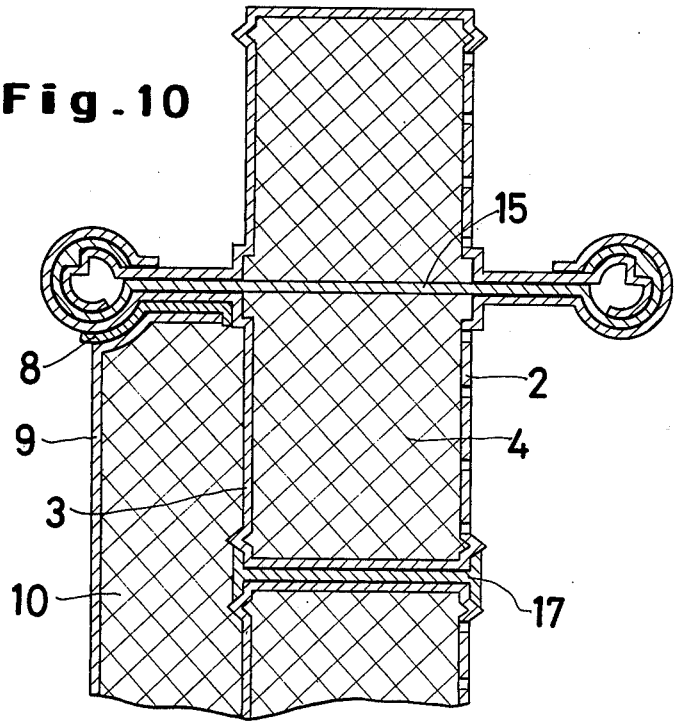

FIG. 9 and FIG. 10 illustrate the conditions in which the extreme boxes are given a perfectly sealed structure when the component boxes are piled up one on top of another and the adjoining perforated sound-absorbing plates and sound-insulating plates are joined tightly and united fast as described above. To be specific, in each of the illustrated structures, a box element 16 which is possessed of legs so shaped as to conform perfectly with the legs of the perforated sound-absorbing plate and the sound-insulating plate of the extreme box is attached to the free end of said extreme box by the medium of the intermediate plate 15, with the respective legs joined tightly in much the same way as the connecting legs of each adjoining pair of component boxes are united in the rest of the assembly having the component boxes piled up one on top of another. The attachment of this box element 16 can be accomplished in entirely the same way as the component boxes are joined with one another in the assembly. The structure illustrated in FIG. 10 is similar to that of FIG. 9 in terms of the end-to-end union. The only difference is that the box element of the structure of FIG. 10 is divided into a plurality of smaller pieces by insertion of elastic insulating materials 17. In this structure, the proper vibration of the box member is isolated by virtue of these elastic insulating materials.

Owing to the incorporation of the free air layer in particular, the noise barrier of the present invention can preclude the otherwise occurring decline in the magnitude of transmission loss due the phenomenon of resonance. In the case of the assembly having the plurality of boxes piled up one on top of another, the desired barrier can easily be completed by adopting any of the structures illustrated in FIGS. 6 through 10. Moreover, the barrier structure may be formed to any desired dimensions to suit the particular kind of noise source. The barrier of this invention manifests an outstanding noise-insulating effect in a broad range of frequence. Thus, the present invention enjoys numerous advantages.

The noise-insulating effect exhibited by the noise barrier wall structure of the present invention results from the combination of the following factors:

1. Attenuation of the phenomenon of resonance by the sound energy which enters the box interior and departs therefrom through the perforations bored in the plate (Dimensionally, the phenomenon of reverberation is desired to be as large as possible.)

2. Reflection and interception of incoming sound waves by the sound-insulating plate.

3. Attenuation of the sound energy received through the perforations owing to the sound-suppressing effect brought about by the layer of air formed inside the tightly sealed compartment.

4. Absorption of incoming sound waves by the sound-absorbing material.

5. Prevention by the elastically joined free-spacing plate of possible decline in the magnitude of transmission loss in the box proper due to the phenomenon of resonance on the higher side of the frequency zone.

6. Ability of the free-spacing plate to intercept sound energy.

7. Non-periodicity attenuation and absorption of sound by the counter-to-resonance occurring inside the free air layer formed within the free air compartment.

There will now be described an extremely effective and simple method for using the principle of the noise barrier according to this invention to directly insulate the noise issuing from a noise source. In the noise barrier described above, a free spacing plate is attached to the hollow cell type block so as to form a free air layer. It has been discovered that simple and effective noise insulation can also be attained merely by providing a free-spacing plate at a distance from a noise source in such a way as to create a free air layer. In applying this method, the position and various properties of the free air layer and free-spacing plate are determined in exactly the same manner as in the case of the noise barrier.

What is claimed is:

1. A cell-box-type noise barrier having a large magnitude of transmission loss and comprising a plurality of single noise barrier structural units, each of said single noise barrier structural units consisting of (A) a hollow cell type block composed of a hollow cell-shaped box having a perforated sound-absorbing plate disposed on the side confronting the source of noise and a sound-insulating plate disposed on the opposite side relative to said perforated sound-absorbing plate and incorporating a sound-absorbing material to fill up the space therein and (B) a free-spacing plate disposed opposite said sound-insulating plate across a space and parallelly to said plate and connected with said sound-insulating plate by the medium of an elastic member so as to give rise to a free air layer between said free-spacing plate and said sound-insulating plate.

2. The cell-box-type noise barrier according to claim 1, wherein said hollow cell-shaped box has its interior divided into a plurality of compartments by insertion of partition plates and said compartments are filled with a sound-absorbing material.

3. The cell-box-type noise barrier according to claim 1, wherein the connecting ends of the perforated sound-absorbing plates and the sound-insulating plates of the noise barrier structural units piled up one on top of another are possessed of outwardly bent legs, whereby the legs of each of the adjoining pairs of the perforated sound-absorbing plates and sound-insulating plates are mutually joined with one another.

4. The cell-box-type noise barrier according to claim 3, wherein the hollow cell-shaped box composing the noise barrier structural unit assembly is divided into a plurality of compartments by insertion of partition plates and said compartments are filled with a sound-absorbing material.

5. The cell-box-type noise barrier according to claim 3, wherein the connecting legs of each vertically adjoining pairs of perforated sound-absorbing plates and sound-insulating plates are attached to and joined with one another by the medium of an intermediate plate.

6. The cell-box-type noise barrier according to claim 3, wherein the extremeties of the connecting legs of the adjoining pair of plates have cross sections of the shape of hooks, one of which is larger than the other and is capable of accommodating the other for tight union.

* * * * *